US010330122B2

(12) United States Patent
Schneider

(10) Patent No.: US 10,330,122 B2
(45) Date of Patent: Jun. 25, 2019

(54) OPERATING METHOD FOR A PUMP, IN PARTICULAR FOR A MULTIPHASE PUMP, AND PUMP

(71) Applicant: Sulzer Management AG, Winterthur (CH)

(72) Inventor: Lorenz Schneider, Schaffhausen (CH)

(73) Assignee: SULZER MANAGEMENT AG, Winterthur (CH)

( * ) Notice: Subject to any disclaimer, the term of this patent is extended or adjusted under 35 U.S.C. 154(b) by 810 days.

(21) Appl. No.: 14/959,187

(22) Filed: Dec. 4, 2015

(65) Prior Publication Data

US 2016/0177958 A1 Jun. 23, 2016

(30) Foreign Application Priority Data

Dec. 18, 2014 (EP) ..... 14198870

(51) Int. Cl.
*F04D 27/02* (2006.01)
*F04D 31/00* (2006.01)
(Continued)

(52) U.S. Cl.
CPC ..... *F04D 31/00* (2013.01); *F04D 15/0011* (2013.01); *F04D 15/0088* (2013.01);
(Continued)

(58) Field of Classification Search
CPC .. F04D 31/00; F04D 15/0088; F04D 15/0011; F04D 27/0223; F04D 27/001;
(Continued)

(56) References Cited

U.S. PATENT DOCUMENTS 6,007,306 A 12/1999 Vilagines
2011/0309668 A1* 12/2011 Efthymiou ..... E02F 3/8866 299/17

FOREIGN PATENT DOCUMENTS

DE 102010047298 A1 4/2012
FR 2685737 A1 7/1993
(Continued)

OTHER PUBLICATIONS

Extended European Search Report dated Jun. 5, 2015 in European Patent Application No. 14198870.9, Filed Dec. 18, 2014.

*Primary Examiner* — Jason D Shanske
*Assistant Examiner* — Maxime M Adjagbe
(74) *Attorney, Agent, or Firm* — Global IP Counselors, LLP

(57) ABSTRACT

An operating method for a pump includes providing a return line for returning the fluid from a high-pressure side to a low-pressure side, controlling a control valve in the return line with a surge control unit for avoiding an unstable operating state, the control valve controlling the throughflow through the return line, storing a limit curve for a control parameter in the surge control unit, comparing an actual value of the control parameter with the limit curve during the operation of the pump; and when the actual value of the control parameter reaches the limit curve, controlling the control valve in the return line such that the actual value of the control parameter is moved away from the limit curve, an operating parameter of the pump being used as the control parameter.

20 Claims, 3 Drawing Sheets

(51) Int. Cl.
*F04D 27/00* (2006.01)
*F04D 15/00* (2006.01)

(52) U.S. Cl.
CPC ..... *F04D 27/001* (2013.01); *F04D 27/0223* (2013.01); *F05D 2270/3015* (2013.01); *F05D 2270/335* (2013.01)

(58) Field of Classification Search
CPC ..... F04D 2270/335; F04D 2270/3015; F04B 47/00; F04B 27/005; F04B 27/067
See application file for complete search history.

(56) References Cited

FOREIGN PATENT DOCUMENTS

| | | | |
|---|---|---|---|
| GB | 2215408 | A | 9/1989 |
| WO | 0106128 | A1 | 1/2001 |
| WO | 2016041990 | A1 | 3/2016 |

* cited by examiner

OPERATING METHOD FOR A PUMP, IN PARTICULAR FOR A MULTIPHASE PUMP, AND PUMP

CROSS-REFERENCE TO RELATED APPLICATIONS

This application claims priority to EP Application No. 14198870.9, filed Dec. 18, 2014, the contents of which is hereby incorporated herein by reference.

BACKGROUND

Field of the Invention

The invention relates to an operating method for a pump, in particular a multiphase pump, and to a pump, in particular a multiphase pump, for conveying a fluid in accordance with the preamble of the independent claim of the respective category.

Background of the Invention

Multiphase pumps are pumps with which fluids can be conveyed which comprise a mixture of a plurality of phases, for example a liquid phase and a gaseous phase. Such pumps have been well known for a long time and are produced in a large number of embodiments, frequently as centrifugal pumps, for example as single-suction pumps or as double-suction pumps and as single-stage or multi-stage pumps. The field of application of these pumps is very wide; they are used, for example, in the oil and gas industry to convey mixtures of petroleum and natural gas and specifically as pressure-elevating pumps which are also called booster pumps.

It is a known technology to increase or extend the utilization or the exploitation of oil fields using such booster pumps. In particular when the naturally present pressure in an oil field decreases as the oil production increases, the pressure exerted on the borehole is reduced by a booster pump due to the conveying of the pump so that the oil can continue to flow out of the borehole.

These pressure-elevating pumps frequently have to generate high pressures because the boreholes are very deep or are difficult to access so that very long lines or pipelines are required between the borehole and the processing or storage devices. This in particular also applies with sub-sea applications when, for example, the outlet of the borehole is on the seabed and the processing or storage equipment is provided on land, on a drilling platform or on a ship as an FPSO (floating production storage and offloading unit). It is necessary for a booster pump to pump over large geodetic heights and to be able to generate a correspondingly high pressure.

SUMMARY

The efficiency and the performance capability of a multiphase pump depend to a very high degree on the current phase composition or phase distribution of the multiphase fluid to be conveyed. The relative volume portions of the liquid phase and of the gaseous phase—for example in oil production—are subject to very large fluctuations, which is due to the natural source, on the one hand, but is also caused by the connection lines, on the other hand. There are several effects here by which the liquid phase can collect in certain regions until the line cross-section is completely filled with the liquid phase and a pressure increase in the gaseous phase arises upstream to a point where the pressure becomes so great that the liquid phase is abruptly expelled. Other interactions between the gaseous phase and the liquid phase can also result in pressure pulsations in the line. The fluctuations in the phase distribution of the multiphase fluid are thus also caused by the architecture and the dynamics of the line system.

Such effects can cause the multiphase pump to enter into an unstable operating state, which is also called a surge or surging, due to too low a flow rate. Such unstable operating states are characterized by extremely fluctuating flow rates, pressure shocks, large performance and pressure fluctuations as well as strong vibrations of the pump. Such unstable operating states represent an extremely great load on the pump itself and on the adjacent installations. If a multiphase pump is operated for too long in such an unstable operating state, this can result in premature material fatigue, much higher wear, defects, up to the failure of the complete pump, whereby disadvantageous effects on the installations provided downstream of the pump result. The failure of the multiphase pump can even lead to the total production process being interrupted, which is naturally very disadvantageous from an economic standpoint.

To remedy or at least to attenuate the problems resulting from variations in the phase distribution, it is known to provide a buffer tank upstream of the multiphase pump whose volume and inner design is adapted to the respective application. This buffer tank acts so-to-say as a filter or as an integrator and can thus absorb or damp sudden changes in the phase distribution of the fluid so that they cannot enter into the inlet of the multiphase pump or only in very weakened form.

However, since such buffer tanks cannot be designed with any desired size and since they can also not damp out all variations of the phase distribution, a security against underflow, or a surge regulator, is frequently provided with a multiphase pump. This is typically also called a surge control or surge protection and is intended to prevent the multiphase pump from entering into such an unstable operating state. It is a known measure for the surge control or regulation to provide a return line through which the fluid conveyed by the multiphase pump can be led back from the pressure side of the pump to the intake side. One or also more control valves, for example two control valves, are provided in this return line and can be controlled by the surge regulator and accordingly allow a smaller or larger flow through the return line. If, for example, two control valves are provided, one is frequently intended to compensate fluctuations in the phase distribution, while the other very quickly opens the total flow cross-section of the return line in the case of extremely large fluctuations. The logic of the surge regulator is usually integrated in the control device of the pump which is nowadays as a rule designed as a digital control system. If very high proportions of gas are present in the multiphase fluid to be pumped, then a cooling system can in particular also be provided in the return line to avoid too great a thermal load or heat build-up.

A flowmeter is furthermore provided between the opening of the return line on the intake side and the inlet of the multiphase pump.

A limit curve is typically stored in the corresponding control unit for the surge regulator. When the limit curve is reached counter-measures have to be initiated. The limit curve is fixed on the basis of a surge limit which indicates the parameter constellations at which the transition into an unstable operating state takes place. This surge limit is determined on the basis of empirical values and/or on the basis of experimentally determined data. The limit curve is then fixed at a certain "safety margin" from the surge limit to avoid unstable operating states during the operation of the pump. If the pump reaches the limit curve during operation, then the surge regulator controls the control valve or control valves such that the backflow in the return line is increased and the pump moves away from the limit curve again.

Surge regulators or securities against underflow known today require knowledge of the current (actual) flow rate, of the current (actual) phase distribution of the conveyed multiphase fluid and the current (actual) rotational speed of the pump. A direct measurement of the flow rate and of the actual phase distribution using a single instrument or sensor is, however, not possible because such measurement instruments are not available. The flowmeter must therefore be designed as a multiphase flowmeter. The multiphase flowmeter determines the flow rate on the basis of a simultaneous technical measurement of directly accessible process values such as the absolute pressure, differential pressure, density and temperature, which are then processed in a semi-empirical model to determine or estimate the actual flow rate and the actual phase distribution of the fluid in the multiphase flowmeter. Such multiphase flowmeters are very complicated, cost-intensive and complex pieces of apparatus which have some further disadvantages. The different sensors in a multiphase flowmeter for measuring the different process parameters have very large variations with respect to the update rate of the respectively determined process parameter. The sensor with the smallest update rate then naturally determines the maximum possible update rate of the multiphase flowmeter. This maximum update rate is sometimes not sufficient to ensure a reliable surge control or a reliable security against underflow. For sub-sea installations and the associated maritime environment in particular, the corresponding pieces of apparatus have even smaller update rates, which further reduces the dynamic performance capability of the surge regulator. Since greater safety margins from the limit curve are thus necessary to avoid unstable operating states, the operating range of the multiphase pump is further restricted.

In addition, these complex multiphase flowmeters require substantial space for their installation which is often not available, for example on platforms, FPSOs or in a sub-sea arrangement on the seabed.

Furthermore, the flow of a multiphase fluid has dynamic effects which vary the actual phase distribution along the line. It would therefore be desirable for a robust and reliable surge control to measure the flow rates directly upstream of the inlet of the pump so that the real phase distribution present in the multiphase pump is also determined. The installation of a multiphase flowmeter directly upstream of the inlet of the pump is, however, often not possible at all, for example for space reasons.

Similar problems can also occur with single-phase pumps, that is with pumps which serve for the conveying of a single-phase fluid, for example a liquid. It is here also frequently necessary or desired to provide surge regulators or securities against underflow for the pump. Surge regulators known today typically use signals from flowmeters which measure the throughflow of the fluid in a correspondingly similar way as described above with reference to the multiphase flowmeters. Similar problems as described further above also result with these flowmeters, namely they can in particular frequently not be positioned at the desired point, or only with a great effort, and their update rates are frequently too small or the delays in the signal transmission are too large so that the surge regulator has to be designed with very large safety margins. The operating range in which the pump can be safely operated is thereby restricted.

Starting from this prior art, it is therefore an object of the invention to propose an operating method for a pump, in particular for a multiphase pump, and a corresponding pump, in particular a multiphase pump, in which a reliable surge control or a reliable security against underflow is realized in a simple manner which is in particular not reliant on complicated multiphase flowmeters or on flowmeters.

The subjects of the invention satisfying this object are characterized by the features of the independent claims of the respective category.

In accordance with the invention, an operating method is therefore proposed for a pump, in particular for a multiphase pump, for conveying a fluid from a low-pressure side to a high-pressure side, wherein a return line is provided for returning the fluid from the high-pressure side to the low-pressure side, in which method a control valve in the return line is controlled by means of a surge control unit for avoiding an unstable operating state, said control valve controlling the flow through the return line, wherein a limit curve for a control parameter is stored in the surge control unit, an actual value of the control parameter is compared with the limit curve during the operation of the pump and wherein, as soon as the actual value of the control parameter reaches the limit curve, the control valve in the return line is controlled such that the actual value of the control parameter is moved away from the limit curve and wherein an operating parameter of the pump is used as the control parameter.

The term "operating parameter" means those parameters which determine the operation of the pump and which can be set by the monitoring or control device of the pump, that is, for example, the rotating speed of the pump, its power consumption, the torque at which the pump is driven, etc. In the sense of this application, such operating parameters are in particular not those which are predefined by the fluid itself, such as the phase distribution of the fluid (in the case of a multiphase fluid) or its viscosity, since these values cannot be input or set at the pump itself.

Since the surge control unit uses an operating parameter for avoiding an unstable operating state of the pump, it is no longer necessary to estimate or determine values which can only be detected with great difficulty—if at all—by measurement, such as the actual phase distribution in the fluid to be conveyed. It is in particular possible to dispense with such complicated and very cost-intensive pieces of apparatus such as a multiphase flowmeter or also a flowmeter and nevertheless to ensure a reliable and stable surge regulation or security against underflow of the pump, in particular of the multiphase pump.

In accordance with a preferred embodiment of the invention, the limit curve indicates a clear correlation between the operating parameter and the pressure difference generated by the pump, in particular by the multiphase pump, because this pressure difference can be determined very simply or can be detected by measurement.

The pressure difference between the pressure at an inlet and the pressure at an outlet of the pump is preferably detected by measurement to compare the actual value of the operating parameter with the limit curve. It can hereby be ensured in a simple manner that the prevailing actual value is detected of exactly that pressure difference which is just being generated by the pump.

It has proven to be advantageous in practice if the operating parameter used by the surge control unit is in a unique relationship with the torque with which the pump is driven.

That torque with which the pump is driven is in particular preferably used as the operating parameter. The recognition that the dependence of the instantaneous torque on the pressure difference generated by the pump allows the fixing of a limit curve which can reliably prevent the pump from entering into an unstable operating state is surprising.

A preferred measure is for the limit curve to indicate the dependence of the torque on the pressure difference at which the pump is still reliably operated in a stable operating state. This means that the limit curve is preferably fixed such that it does not run exactly where the transition of the pump into an unstable operating state takes place, but rather that a safety reserve is provided.

It is advantageous for this purpose if the limit curve is fixed at a spacing from a lower surge limit line, wherein the lower surge limit line indicates the respective value of the operating parameter at which the pump moves into an unstable operating state.

This lower surge limit line is preferably determined with the aid of experimental test data for whose determination the pump is led into an unstable operating state. This can take place, for example, in a test stand before taking the pump into operation, where the pump is then deliberately brought into an unstable operating state (surging) in order thus to determine at which values of the operating parameter this transition takes place.

It can naturally also be advantageous if empirical values are used for determining the lower surge limit line. Time can hereby be saved by reducing the experimental effort to determine the lower surge limit line for the respective pump.

From the point of view of the apparatus it is preferred if the surge control unit is integrated into a control device for the control of the pump.

To minimize the cost and complexity and thus to make the operating method particularly simple, it is an advantageous measure if the actual value of the operating parameter is provided by a variable frequency drive for the pump.

It is a preferred use of the operating method when the pump is used as a pressure-elevating pump (booster pump) for oil production and gas production, in particular in sub-sea oil production and gas production.

A pump, in particular a multiphase pump, is furthermore proposed by the invention for conveying a fluid from a low-pressure side to a high-pressure side, having an inlet and an outlet for the fluid and having a surge control unit for avoiding an unstable operating state which provides a control signal for a control valve in a return line for returning the fluid from the high-pressure side to the low-pressure side, wherein a limit curve for a control parameter is present in the surge control unit, wherein the surge control unit compares an actual value of the control parameter during the operation of the pump with the limit curve and wherein the surge control unit provides the control signal as soon as the actual value of the control parameter reaches the limit curve, said control signal being able to control the control valve in the return line such that the actual value of the control parameter is moved away from the limit curve, wherein the control parameter is an operating parameter of the pump.

The advantages and the preferred embodiments of the pump in this respect correspond to those which are explained above in connection with the operating method in accordance with the invention.

It is in particular also particularly preferred with respect to the pump if the operating parameter is the torque for driving the pump and the limit curve indicates the dependence of the torque on the pressure difference between the pressure at the inlet and the pressure at the outlet.

The pump is preferably designed as a centrifugal pump and as pressure-elevating pump for oil production and gas production, in particular for sub-sea oil production and gas production.

An extremely reliable surge control for avoiding unstable operating states is possible by the operating method in accordance with the invention or by the pump in accordance with the invention. Since the operating parameter required for the control is very simple and is available with a very high update rate, very fast changes in the process conditions can also be recognized and responded to. It is specifically ensured by the use of the operating parameter of the pump in sub-sea applications that there are no signal delays which are caused, for example, by the components installed under water or by their connection to the components arranged above water. The advantage further results that the safety margin from the unstable operating states can be reduced or can be minimized so that the pump can be operated in a much larger operating range.

A further advantage of the operating method in accordance with the invention and of the pump in accordance with the invention is that they can also be retrofitted without problem into already existing pumps, i.e. that existing pumps can be modified into pumps in accordance with the invention in a simple manner. For this purpose larger apparatus modifications are frequently not required.

Further advantageous measures and embodiments of the invention result from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
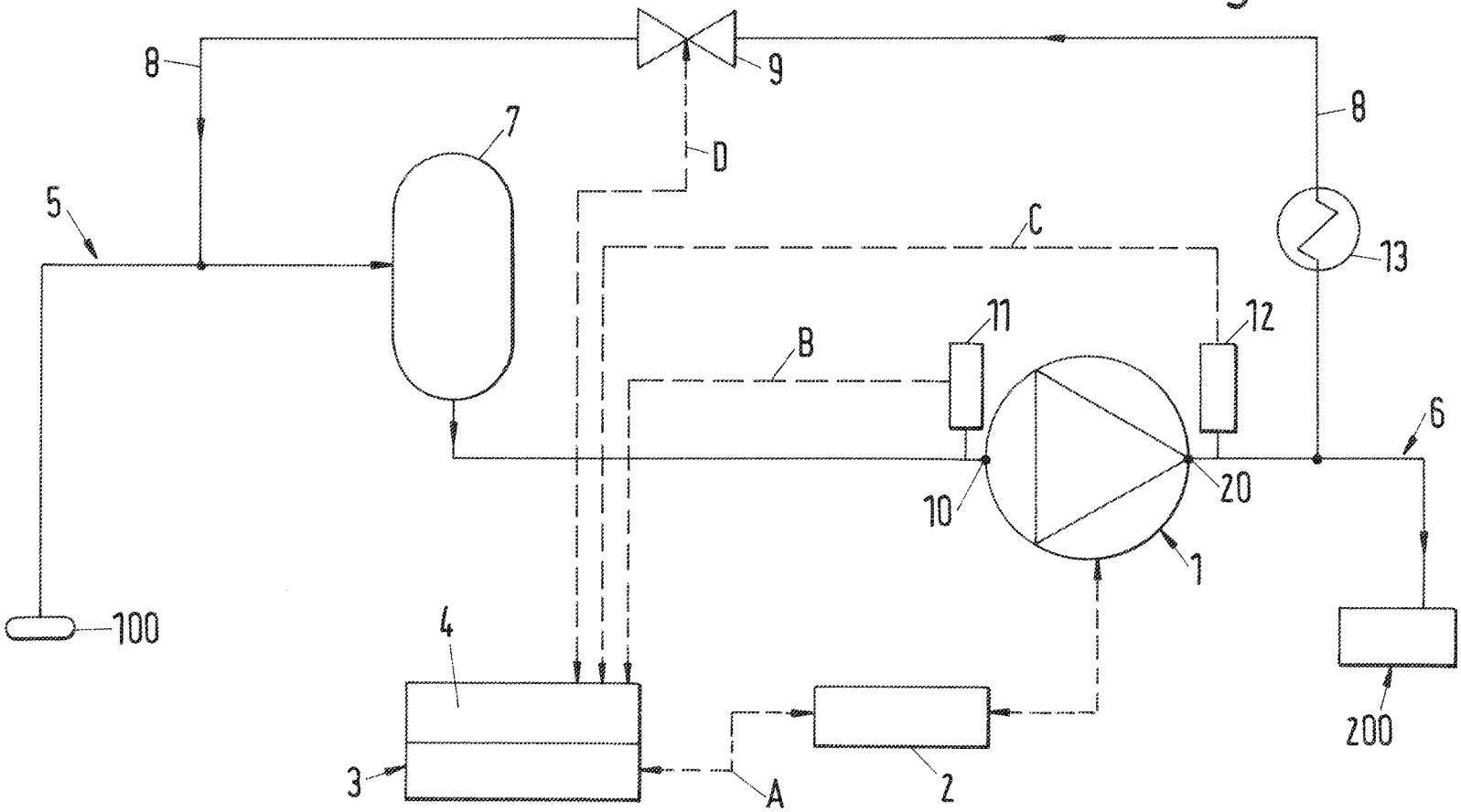
FIG. 1 is a schematic representation for illustrating an embodiment of the invention.

FIG. 1 illustrates in a schematic representation an embodiment of the invention in both an apparatus respect and a technical method respect. In the following, an embodiment of the operating method in accordance with the invention and an embodiment of a pump in accordance with the invention, which is designated as a whole by the reference numeral 1, will be explained with reference to FIG. 1. The pump is configured as a multiphase pump. In this respect, reference is made with an exemplary character to the application important in practice that the multiphase pump 1 is configured as a centrifugal pump and as a pressure-elevating pump which is also typically called a booster pump. In this application, the multiphase pump is used for oil production and gas production and in particular for sub-sea oil production and gas production in which the outlet of a borehole 100 is located on the seabed from where the petroleum and the natural gas are conveyed to a storage and processing apparatus 200 arranged above the ocean. The borehole 100 extends up to and into an oil field which is not shown in FIG. 1. In this respect, the storage and processing apparatus 200 can be installed on land or also in the offshore region, for example on a platform which is anchored on the seabed. The storage and processing apparatus 200 can naturally also be arranged floating on the ocean, for example in the form of an FPSO.

In this embodiment, the fluid to be conveyed by the multiphase pump 1 is therefore a multiphase fluid which comprises at least one gaseous phase and one liquid phase. It is the job of the multiphase pump 1 used as a booster pump in this respect to lower the pressure at the outlet of the borehole 100, for example to a value in the range from 10 bar to 40 bar, so that the fluid can exit the borehole 100 or so that the flow rate of the fluid conveyed from the borehole 100 is increased. This measure, which is known per se, is in particular advantageous as the degree of exhaustion of the oil field increases because the natural pressure prevailing in the oil field then decreases. The multiphase pump 1 can, for example, generate pressure differences of up to 150 bar, with the generated pressure difference naturally greatly depending on the actual density of the fluid and thus on its actual phase distribution. Depending on the application, the multiphase pump 1 can be arranged on the seabed in the vicinity of the borehole 100 or at some distance therefrom or in the offshore region, that is, for example, on a (drill) platform or on an FPSO or also on land.

The invention is naturally not restricted to this specific application, but is also suitable for all other applications in which multiphase pumps can be used or deployed. The invention is in particular suitable for multiphase pumps which are centrifugal pumps. The invention is also not restricted to multiphase pumps, but is rather generally suitable for pumps, that is also for single-phase pumps, in which the fluid to be conveyed only includes one phase, which is for example a liquid.

Lines through which the fluid can flow are shown by solid lines in FIG. 1, whereas signal connections are shown as dashed lines.

The multiphase pump 1 includes an inlet 10 through which the fluid enters into the multiphase pump 1 as well as an outlet 20 through which the conveyed fluid exits the multiphase pump 1. In the following, the region disposed upstream of the multiphase pump 1 is called the low-pressure side and the region disposed downstream is called the high-pressure side.

A first pressure sensor 11 with which the pressure at which the fluid flows into the multiphase pump 1 can be measured is disposed at the inlet 10 of the multiphase pump 1. A second pressure sensor 12 with which the pressure at which the fluid exits the multiphase pump 1 can be measured is disposed at the outlet 20 of the multiphase pump. The respective actual value of the pressure difference generated by the multiphase pump 1 can thus be determined from the difference signal of the two pressure sensors 11, 12. All pressure sensors known per se are suitable as pressure sensors 11, 12. The pressure sensors 11, 12 are preferably each arranged directly at the inlet 10 or at the outlet 20 of the multiphase pump 1.

The multiphase pump 1 is driven by a variable frequency drive 2 (VFD, or also a variable speed drive, VSD) which sets the shaft of the multiphase pump 1 into rotation together with the impeller or impellers (not shown) arranged thereon. The variable frequency drive 2 is in signal communication with a control device 3 for the control of the multiphase pump, as the double arrow A in FIG. 1 indicates, and can exchange data bi-directionally with the control device 3. The control device 3 is preferably configured as a digital control device 3.

The two pressure sensors 11 and 12 are each in signal communication with the control device 3, as the two arrows B and C in FIG. 1 indicate.

A surge control unit 4 is furthermore provided for preventing unstable operating states of the multiphase pump 1 and is preferably integrated into the control device 3. The terms "security against underflow" or "surge control" are also typically used for the surge control unit 4.

The inlet 10 of the multiphase pump 1 is connected at the low-pressure side to the borehole 100 via a supply line 5 through which the fluid can flow from the borehole 100 to the inlet 10. The outlet 20 of the multiphase pump 1 is connected at the high-pressure side to the storage and processing apparatus 200 via an outlet line 6 through which the fluid can flow from the multiphase pump 1 to the storage and processing apparatus 200. Depending on where the multiphase pump 1 is arranged in the respective case, the supply line 5 and the outlet line 6 can each have a length of less than one meter up to several kilometers.

A buffer tank 7 is preferably provided in the supply line 5 which serves in a manner known per se to compensate variations in the phase distribution of the fluid. These variations can be caused by naturally instigated fluctuations of the gas-to-liquid ratio of the fluid exiting the borehole or also by the architecture and the line dynamics of the supply line 5. The buffer tank 7 acts as a filter or as an integrator and can thus absorb or damp abrupt changes in the phase distribution of the fluid.

A return line 8 for the fluid is furthermore provided which connects the high-pressure side to the low-pressure side. The return line 8 branches off from the outlet line 6 downstream of the outlet 20 of the multiphase pump 1 and opens upstream of the buffer tank 7 into the supply line 5 so that the fluid can be led back through the return line 8 from the high-pressure side to the low-pressure side. At least one control valve 9 is provided in the return line 8 and is in signal communication with the surge control unit 4, as the arrow D in FIG. 1 indicates. The control valve 9 is designed as a regulation valve with which the flow cross-section of the return line 8 can be varied from the completely closed state (no return of fluid) up to the completely open state (maximum flow cross-section). The return line 8 serves for the surge control and thus for the avoidance of unstable operating states of the multiphase pump 1 which are also known as surging.

If the flow through the multiphase pump 1 is large enough, the control valve 9 is completely closed so that no fluid can flow back through the return line 8 to the low-pressure side. If, as will be described further below, the exceeding of a limit curve for a control parameter is detected by the surge control unit 4, due, for example, to too little fluid arriving at the inlet 10 (underflow region), then the surge control unit 4 controls the control valve 9 such that it opens the return line 8 partially or fully so that a portion of the conveyed fluid can flow back from the high-pressure side to the low-pressure side. The control valve 9 is in this respect opened so wide until the actual value of the control parameter again lies below the limit curve.

The control valve 9 is preferably configured such that it can vary the open flow cross-section of the return line 8 continuously from the completely closed state up to the completely open state. It is naturally also possible to provide more than one control valves, for example, two control valves, in the return line 8 which are then arranged in parallel in the return line 8. Alternatively, two valves can also be arranged after one another, that are in series, in the return line 8, with one of the two valves then preferably being a fast Open/Closed valve and the other valve being a control valve which is configured as a regulation valve.

A cooling 13, for example a heat exchanger, can furthermore be provided in the return line 8 to extract heat from the recirculated fluid. This measure is in particular advantageous when the fluid has a high gas portion. Heat build-ups can then be prevented by the cooling 13.

As already mentioned, the surge control unit 4 uses the actual value of a control parameter to avoid unstable operating states of the multiphase pump 1 or of the pump 1. This control parameter is an operating parameter in accordance with the invention. As already explained, the term "operating parameter" means those parameters which can determine the operation of the pump 1 and which can be set by the control device 4 of the pump 1, that is, for example, the rotational speed of the multiphase pump 1, its power consumption, the torque at which the multiphase pump 1 is driven, etc. Operating parameters are therefore those values which regulate the operation of the pump 1 or of the multiphase pump 1 and which can be set directly—or indirectly via a different operating parameter—at the pump 1 or at the multiphase pump 1.

The use of an operating parameter as a control parameter in particular has the advantage that those process values which cannot be determined or which can only be determined with a great effort or only very inaccurately, such as the actual phase distribution of the fluid, no longer have to be known for the surge control. In the case of an embodiment of the pump as a single-phase pump, it is, for example, no longer necessary to know the actual flow so that flowmeters can be dispensed with.

In the embodiment described here, the relationship between the operating parameter and the pressure difference generated by the multiphase pump 1 is used for the surge control. This pressure difference can be determined by measurement very easily and very accurately by means of the two pressure sensors 11 and 12 during the operation of the multiphase pump 1.

Figure 2:
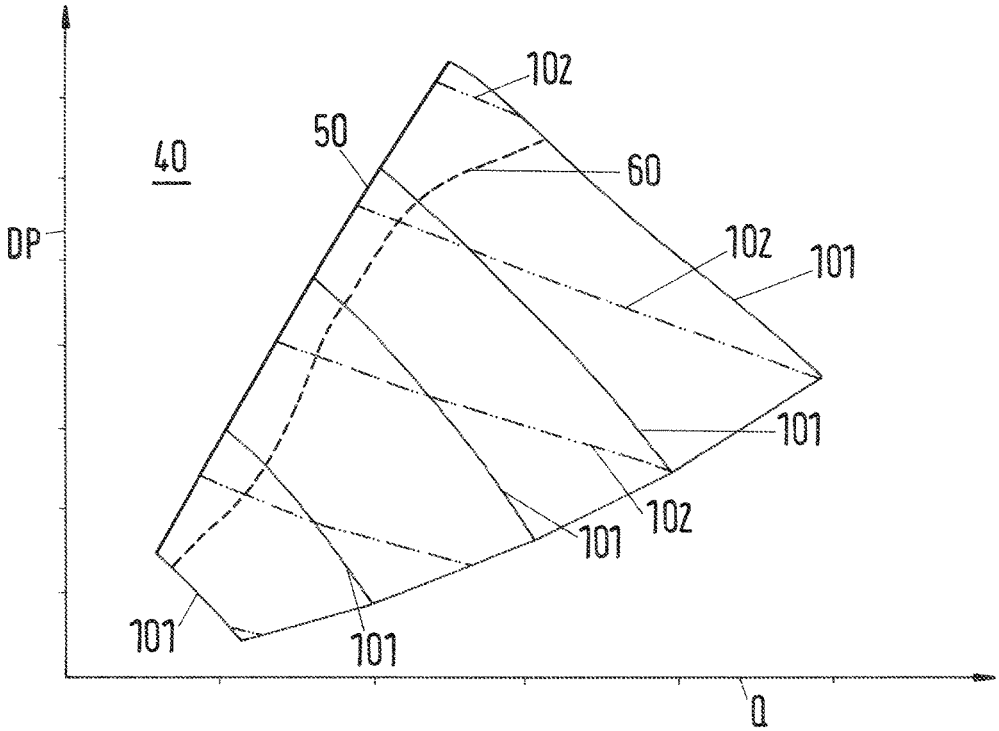
FIG. 2 is a representation of the relationship of the pressure difference generated by the embodiment of the multiphase pump with the flow rate.

FIG. 2 shows, for a better understanding, a typical operating diagram of the multiphase pump 1 in which the relationship of the pressure difference generated by the multiphase pump 1 with the flow rate of the fluid conveyed by the multiphase pump 1 is shown. The flow rate Q is applied on the horizontal axis and the pressure difference DP on the vertical axis. With a multiphase fluid, this relationship naturally depends very much on the phase distribution of the conveyed fluid. This phase distribution of a fluid having a liquid phase and a gaseous phase is typically characterized by the GVF value (GVF: gas volume fraction) which indicates the ratio from the volume flow of the gas phase and the volume flow of the fluid. The GVF value therefore lies between 0 and 1 or between 0 and 100%, where the value 0 means that only a liquid phase is present and the value 1 or 100% means that only a gaseous phase is present.

FIG. 2 shows the pressure difference DP in dependence on the flow rate Q for five different GVF values. The respective GVF value is constant on the iso-GVF curves designated by 101 and shown as solid lines. In this respect, the lowest iso-GVF curve 101, or the curve the furthest to the left according to the representation, corresponds to the largest GVF value. The higher or the further right in the diagram the iso-GVF curve 101 is, the smaller the associated GVF value is. In addition, iso-power curves 102 are also shown as chain-dotted lines in FIG. 2 on which the respective power consumed by the multiphase pump 1 is constant.

A lower surge limit line 50 is furthermore shown in FIG. 2 (by a solid line) which is typically also called a surge line. If this lower surge limit line 50 is exceeded so that the multiphase pump 1 moves in the region marked by 40 above the lower surge limit line 50, the multiphase pump 1 is in an unstable operating state. It can easily be recognized with reference to FIG. 2 how changes in the actual phase distribution of the fluid can very abruptly result in the lower surge limit line 50 being exceeded and thus in unstable operating states. A change of the actual phase distribution corresponds, for example, to a jump from one iso-GVF curve 101 to another.

In order reliably to avoid such unstable operating states in the region 40 during the operation of the multiphase pump 1, a limit curve 60 is fixed for the operating parameter used as a control parameter and is spaced apart from the lower surge limit line 50, below the lower surge limit line 50 in the representation in accordance with FIG. 2. The limit curve 6 is shown as a dashed line in FIG. 2.

If the operating parameter used as the control parameter now reaches the limit curve 60 during the operation of the multiphase pump 1, the surge control unit 4 controls the control valve 9 such that the flow through the return line 8 is increased, and indeed so much until the actual value of the operating parameter used as the control parameter moves away from the limit curve 60 and from the region 40 of unstable operating states.

It is naturally necessary for this purpose that a limit curve or a lower surge limit line is known for the operating parameter specifically used in the surge control unit and its progression is known in dependence on a value which can be measured or determined simply and reliably during the operation of the multiphase pump 1.

In this connection, it has proved to be particularly advantageous when the dependence of the operating parameter on the pressure difference is determined by the pressure difference which is actually generated by the multiphase pump 1. The limit curve or the lower surge limit line then indicates a unique relationship between the operating parameter and the pressure difference.

In principle, all operating parameters are suitable for the surge control. It has, however, proved to be advantageous for the operating parameter to be in a unique relationship with the torque at which the multiphase pump 1 is driven. The torque at which the multiphase pump 1 is driven is in particular preferably used as the operating parameter.

The torque is an operating parameter which is constantly available in operation and thus allows a very high update rate. The actual value of the torque taken up by the multiphase pump 1 can be provided at any time by the variable frequency drive 2.

The pressure difference DP can be measured in a very simple and reliable manner by means of the two pressure sensors 11, 12 which transfer the pressure values measured by them via the signal connections B and C respectively to the surge control unit 4 which determines the actual value of the pressure difference DP from it.

To determine a limit curve 60' (see FIG. 3) or a lower surge limit line 50' for the torque taken up by the multiphase pump 1, experimental data are preferably used which are determined on a test stand, for example, before the putting into operation of the multiphase pump 1.

Figure 3:
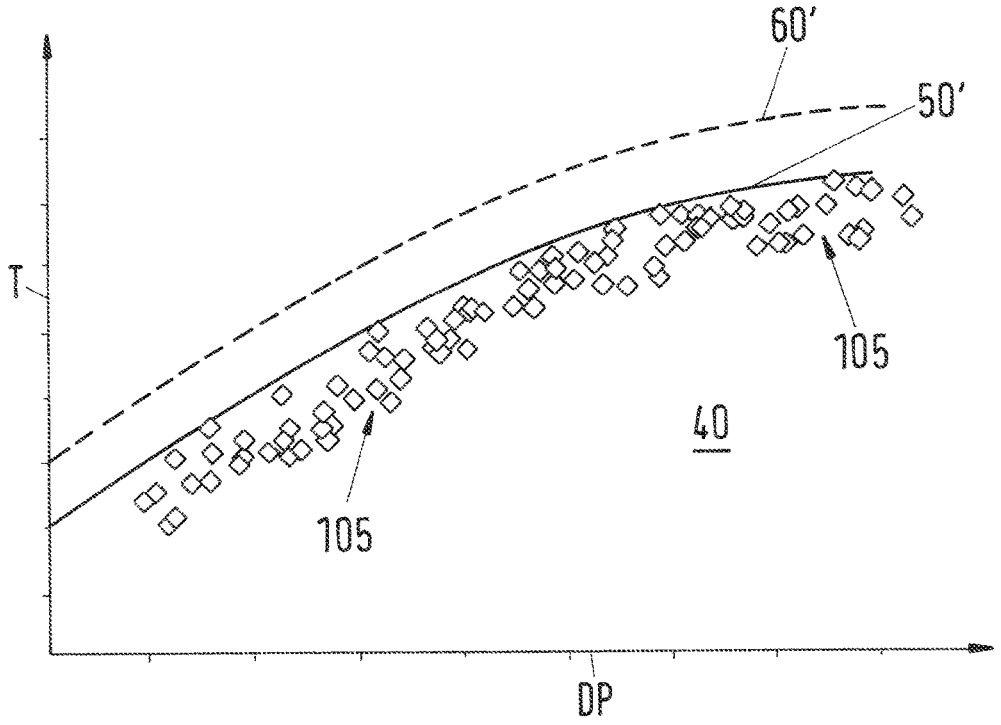
FIG. 3 is a representation of a limit curve and of a lower surge limit line in an application of the torque against the pressure difference.

FIG. 3 shows a representation of the limit curve 60' and of the lower surge limit line 50' in an application of the torque against the pressure difference. The pressure difference DP is shown on the horizontal axis and the torque T taken up by the multiphase pump is shown on the vertical axis. The diamonds marked by 105 represent experimentally determined test data in which the multiphase pump runs in an unstable operating state. To determine these test data 105, the multiphase pump 1 is deliberately brought into an unstable operating state on a test stand, for example by varying the throughflow and/or by varying the phase distribution of the fluid. The latter is naturally possible in a test stand. In this respect, it is respectively determined at which values of the torque T and at which values of the pressure difference DP the multiphase pump 1 enters into an unstable operating state. These unstable operating states can be detected very simply, for example by the occurrence of strong vibrations, by an abrupt lowering of the conveying pressure at the outlet 20 of the multiphase pump 1 or by other changes. The test data 105 can be determined in this manner.

Subsequently, the lower surge limit line 50' is then fixed so that—in accordance with the representation in FIG. 3—all the test data 105 lie just below the lower surge limit line 50'. The limit curve 60' shown as a dashed line in FIG. 3 is then determined with a safety margin above, and preferably extending in parallel with, the lower surge limit line 50'. Selecting a margin between the lower surge limit line 50' and the limit curve 60' suitable for the application does not present any problems for the skilled person. It is now certain for the operation of the multiphase pump 1 that the multiphase pump 1 does not enter into an unstable operating state as long as it is operated above the limit curve 60' in accordance with the illustration (FIG. 3).

Alternatively or additionally, it is also possible to use empirical values for the determination of the limit curve 60' which were already determined by means of other pumps, for example, or which are known in a different manner. Calculated operating data or data gained by simulations can also alternatively or additionally be used for determining the lower surge limit line 50' or the limit curve 60'.

The limit curve 60' is now stored in the surge control unit 4 for normal operation. This can be implemented, for example, in that the limit curve 60' is stored as a look-up table or as an analytical parameterized function in the surge control unit 4. If the determined relationship between the operating parameter, here the torque T, and the pressure difference DP is particularly simple, for example linear, a corresponding function, for example a linear equation, can be stored in the surge control unit 4. During the operation of the multiphase pump 1, the surge control unit 4 determines the respective actual value of the pressure difference DP, which is just generated by the multiphase pump 1, by means of the signals of the pressure sensors 11, 12. The surge control unit 4 can now determine, using the actual value for the torque T provided by the variable frequency drive 2, whether the actual value of the torque T is still remote from the limit curve 60' by a comparison with the limit curve 60'. As soon as the actual value of the torque T for the actual pressure difference DP reaches the limit curve 60', the surge control unit 4 controls the control valve 9 in the return line 8 such that the return line 8 thereby opens or opens wider. The return line 8 is opened further until the torque T again moves away from the limit curve 60' and from the lower surge limit line 50'.

It is hereby ensured that the multiphase pump 1 does not enter into an unstable operating state during normal operation. In this respect, the very high update rates are particularly advantageous at which the pressure difference DP and the actual value of the operating parameter, here the torque T, can be determined.

It has been found that the fixing of the limit curve with reference to a correlation of the torque T which is taken up by the multiphase pump 1 with the pressure difference DP which is generated by the multiphase pump 1 results in a unique relationship for the respective hydraulic configuration which is otherwise independent of the current operating conditions of this multiphase pump 1 such as the actual phase distribution in the multiphase fluid.

Although the invention has been described with reference to the embodiment of a multiphase pump 1, it is understood that the invention is not restricted to multiphase pumps, but rather also encompasses in the same sense single-phase pumps and pumps in general. In this respect, the pump can respectively be configured as a single-stage pump or as a multi-stage pump. The pump is preferably configured as a centrifugal pump or as a helico-axial pump.

The invention claimed is:

1. An operating method for a pump for conveying a fluid from a low-pressure side to a high-pressure side, the method comprising:

providing a return line for returning the fluid from the high-pressure side to the low-pressure side;

controlling a control valve in the return line with a surge control unit for avoiding an unstable operating state, the control valve controlling throughflow through the return line;

storing a limit curve for a control parameter in the surge control unit;

comparing an actual value of the control parameter with the limit curve during the operation of the pump; and when the actual value of the control parameter reaches the limit curve, controlling the control valve in the return line such that the actual value of the control parameter is moved away from the limit curve, an operating parameter of the pump being used as the control parameter.

2. The method in accordance with claim 1, further comprising indicating, with the limit curve, a unique relationship between the operating parameter and a pressure difference generated by the pump.

3. The method in accordance with claim 1, further comprising detecting the pressure difference between the pressure at an inlet and the pressure at an outlet of the pump by measurement for comparison of the actual value of the operating parameter with the limit curve.

4. The method in accordance with claim 1, wherein the operating parameter is in a unique relationship with a torque at which the pump is driven.

5. The method in accordance with claim 1, wherein a torque at which the pump is driven is used as the operating parameter.

6. The method in accordance with claim 5, further comprising indicating, with the limit curve, a dependence of the torque on the pressure difference at which the pump is still operated in a stable operating state.

7. The method in accordance with claim 1, further comprising fixing the limit curve at a spacing from a lower surge limit line, the lower surge limit line indicating a respective value of the operating parameter at which the pump changes into an unstable operating state.

8. The method in accordance with claim 7, further comprising determining the lower surge limit line using experimental test data by which determination the pump is led into an unstable operating state.

9. The method in accordance with claim 7, wherein empirical values are used for determining the lower surge limit line.

10. The method in accordance with claim 1, wherein the surge control unit is integrated into a control device programmed to control the pump.

11. The method in accordance with claim 1, wherein the actual value of the operating parameter is provided by a variable frequency drive for the pump.

12. The method in accordance with claim 1, wherein the pump is used as a booster pump in oil production and gas production.

13. The method in accordance with claim 1, wherein the pump is used as a booster pump in sub-sea oil production and gas production.

14. The pump in accordance with claim 1, wherein the pump is a multiphase pump.

15. A pump for conveying a fluid from a low-pressure side to a high-pressure side, comprising:

an inlet and an outlet for the fluid; and a surge control unit configured to avoid an unstable operating state, which provides a control signal for a control valve in a return line for returning the fluid from the high-pressure side to the low-pressure side, and including a limit curve for a control parameter, the surge control unit being configured to compare an actual value of the control parameter during the operation of the pump with the limit curve and provide the control signal when the actual value of the control parameter reaches the limit curve, the control signal being capable of controlling the control valve in the return line such that the actual value of the control parameter moves away from the limit curve, the control parameter being an operating parameter of the pump.

16. The pump in accordance with claim 15, wherein the operating parameter is a torque configured to drive the pump and the limit curve indicates a dependence of the torque on a pressure difference between a pressure at the inlet and a pressure at the outlet.

17. The pump in accordance with claim 15, wherein the pump is a centrifugal pump.

18. The pump in accordance with claim 15, wherein the pump is a pressure-elevating pump for oil production and gas production.

19. The pump in accordance with claim 15, wherein the pump is a pressure-elevating pump for sub-sea oil production and gas production.

20. The pump in accordance with claim 15, wherein the pump is a multiphase pump.

* * * * *